US005657834A

United States Patent [19]

Plaugher et al.

[11] Patent Number: 5,657,834

[45] Date of Patent: Aug. 19, 1997

[54] MAST STAGING CUSHION APPARATUS

[75] Inventors: Randall D. Plaugher, Wapakoneta; James L. Hoying, Chickasaw; John R. Harman, Versailles, all of Ohio

[73] Assignee: Crown Equipment Corporation, New Bremen, Ohio

[21] Appl. No.: 515,465

[22] Filed: Aug. 15, 1995

Related U.S. Application Data

[63] Continuation-in-part of Ser. No. 298,435, Aug. 30, 1994, abandoned.

[51] Int. Cl.[6] ..... B66F 9/06

[52] U.S. Cl. ..... 187/226; 414/630

[58] Field of Search ..... 187/226, 222, 187/234, 343, 344; 414/630, 631

[56] References Cited

U.S. PATENT DOCUMENTS 4,476,960 10/1984 Yarris ..... 187/226

4,538,954 9/1985 Luebke ..... 187/226

4,848,519 7/1989 Ericson et al. ..... 187/343

*Primary Examiner*—Kenneth Noland

*Attorney, Agent, or Firm*—E. Paul Forgrave

[57] ABSTRACT

A lift truck provided with a fixed mast section, several moveable mast sections and a carriage supporting load carrying forks and operator's platform is hydraulically raised and lowered. Mast chains interconnect the fixed mast section and the moveable mast sections and the moveable mast sections and the carriage. One pair of cushioning devices is placed between the fixed mast section and lower most moveable mast section and a second pair of cushioning devices is placed between the uppermost moveable mast section and the carriage. Each cushioning device two spring elements, one with a relatively soft spring rate, the other with a relatively stiff spring rate. The cushioning devices and a common hydraulic connection between hydraulic cylinders combine to reduce the shock and jerk felt by the operator during mast staging while raising or lowering the mast in either an empty or loaded condition.

4 Claims, 4 Drawing Sheets

120
57
56
55
130
125
70
62
60
10
65
66
WL
64
67
50
45
27
15
35
105
100
25
26
110
20
HY PUMP
40

MAST STAGING CUSHION APPARATUS

This application is a continuation-in-part of application Ser. No. 08/298,435 filed Aug. 30, 1994 now abandoned.

BACKGROUND OF THE INVENTION

This invention relates to a mast staging cushion apparatus for use with lift tracks.

Conventional lift trucks are industrial vehicles for cargo handling which have masts for raising and lowering a load. The masts telescope to achieve desired lifting heights and maintain a low collapsed profile. A common telescopic mast uses a fixed mast section (first stage) and one, two, or three additional moveable mast sections (second, third and fourth stage). A carriage assembly supporting the load carrying forks and/or an operator's platform mounted on the telescoping mast may be raised from floor level to the maximum lift height of the mast. Two distinct load movements may occur: elevation of the load without extension of the moveable mast section(s) (free lift) and above this height, elevation of the load with corresponding upward movement of the moveable mast section(s) (staged lift). In sequence, the telescoping sections are collapsed to the height of the fixed section and the carriage is raised from floor level until reaching the top of the telescopic section in which it is mounted. Further elevation of the carriage then causes the moveable section(s) to telescope upwardly until the carriage reaches maximum lift height. Staged lift and free lift hydraulic cylinders and lifting chains are used to move the carriage and the mast sections in the proper sequence.

One problem with the telescopic mast structure occurs during mast staging (i.e. at the transition between free lift and staged lift movements). When staging occurs, sudden start (during lift) or stopping (during lowering) of the moveable mast sections creates impact loads (shocks) and rapid changes in acceleration (jerks) that can be a source of noise and discomfort for the operator. Historically, various mechanical cushioning devices or hydraulic cylinder cushions have been used to reduce these effects during staging. These devices are marginally effective and typically work for raising only or lowering only but not for both. Common designs use a mechanical bumper or spring for raising and a hydraulic cylinder cushion for lowering. Also, the effectiveness of these types of cylinder cushions are influenced by changing loads or operating speeds which is not desirable.

SUMMARY OF THE INVENTION

The present invention has the following purposes: to minimize the source of noise and discomfort for the operator by minimizing the shock and jerk during the staging of the mast while raising and lowering; and to directly replace staged lift cylinder cushions within the cylinders.

The mast staging cushion apparatus of the present invention consists of two sets of cushion elements: an upper set positioned between the carriage and the upper most moveable mast section and a lower set positioned between the fixed mast section and the lower most moveable mast section. Each set of cushion elements (upper or lower) includes one cushioning device or several smaller cushioning devices arranged in parallel to share the load if it is more convenient to do so. Each cushioning device is made up of two distinct spring elements: one element with a relatively soft spring rate and one element with a relatively stiff spring rate.

Each spring element has a distinct intended function within the system, but due to the whole system configuration, each element will complement the others in performing the intended function.

The relatively soft spring element in the lower set is a helical compression spring designed to assist the staged lift cylinder hydraulic force attempting to raise the mast by effectively counterbalancing part of the weight of the moveable mast stages. The assisting spring force will gradually decrease and the required staged lift cylinder hydraulic force will gradually increase with the upward movement of the staged lift cylinder and the moveable mast sections from the collapsed position to the point of full extension of the spring element.

The relatively stiff spring element in the lower set is a polymeric bumper designed to isolate the lower most moveable mast section from metal to metal contact with the fixed mast section when the cushioning devices are engaged. It also serves to absorb the impact energy when the cushioning device is collapsed and the lower most mast section contacts the fixed mast section at some finite velocity during lowering. Further, it serves to provide a near firm positioning stop between the lower most moveable mast section and the fixed mast section when the mast is collapsed.

The relatively soft spring element in the upper set is a helical compression spring designed to oppose the free lift cylinder hydraulic force attempting to raise the mast by resisting the relative upward movement of the carriage along the upper most moveable mast section. The spring force will gradually increase and the required free lift cylinder hydraulic force will gradually increase with the upward movement of the free lift cylinder and carriage from the point of engagement of the cushioning device near the end of the free lift cylinder stroke to the point of full compression of the spring element.

The relatively stiff spring element in the upper set is a polymeric bumper designed to isolate the upper most moveable mast section from metal to metal contact with the carriage when the cushioning devices are engaged. It also serves to absorb the impact energy when the cushioning device is collapsed and the carriage contacts with the upper most moveable mast section at some finite velocity during raising. It also serves to provide a near firm mast positioning stop between the carriage and the uppermost moveable mast section when the mast is extended.

The unique feature resulting from the counteracting spring elements (i.e. the spring elements in the lower set of cushioning devices extend as the spring elements in the upper set of cushioning devices retract during raise staging and vice versa during lower staging) and the common hydraulic connection between the staged lift and the free lift cylinders is that the staging pressure differential can be effectively reduced to zero through some specific portions of the cylinder strokes creating staging transition zone where the staged lift and free lift cylinders can retract or extend simultaneously. This gradually accelerates or decelerates the moveable mast sections during the staging transition, thus reducing the jerk, as well as reducing the relative velocities between the stages thus reducing the impact. The bumpers absorb the remaining impact energy over some finite length of stroke, further reducing the staging shock. This system functions equally well for both raising and lowering and regardless of fork load or speed.

It is therefore an object of this invention to provide an improved mast staging cushion apparatus that includes cushioning devices positioned between a moveable carriage and an upper most moveable section and between a lower most moveable mast section and a fixed mast section.

It is another object of this invention to provide a mast staging cushion apparatus which minimizes the shock and jerk felt by an operator during staging a mast on a lift truck while raising and lowering, and regardless of fork load or speed.

It is a further object of this invention to provide, in a lift truck comprising a fixed mast section (first stage), two moveable mast sections (second and third stages) and a carriage supporting load carrying forks and an operator's platform; staged lift hydraulic cylinders placed between said first and second stage mast sections and free lift cylinders placed between said third stage section and said carriage; a first set of mast chains interconnecting said first and third stage mast sections and a second set of mast chains interconnecting said third stage mast section and said carriage; the improvement comprising a first cushioning device placed between said first stage and said second stage mast section and a second cushioning device placed between said third stage section and said carriage to collectively serve to minimize the jerk and shock felt by the operator during staging of the mast when raising or lowering and regardless of fork load speed.

Other objects and advantages of the invention will be apparent from the following description, the accompanying drawings and the appended claims.

DESCRIPTION OF THE PREFERRED EMBODIMENT

Figure 1:
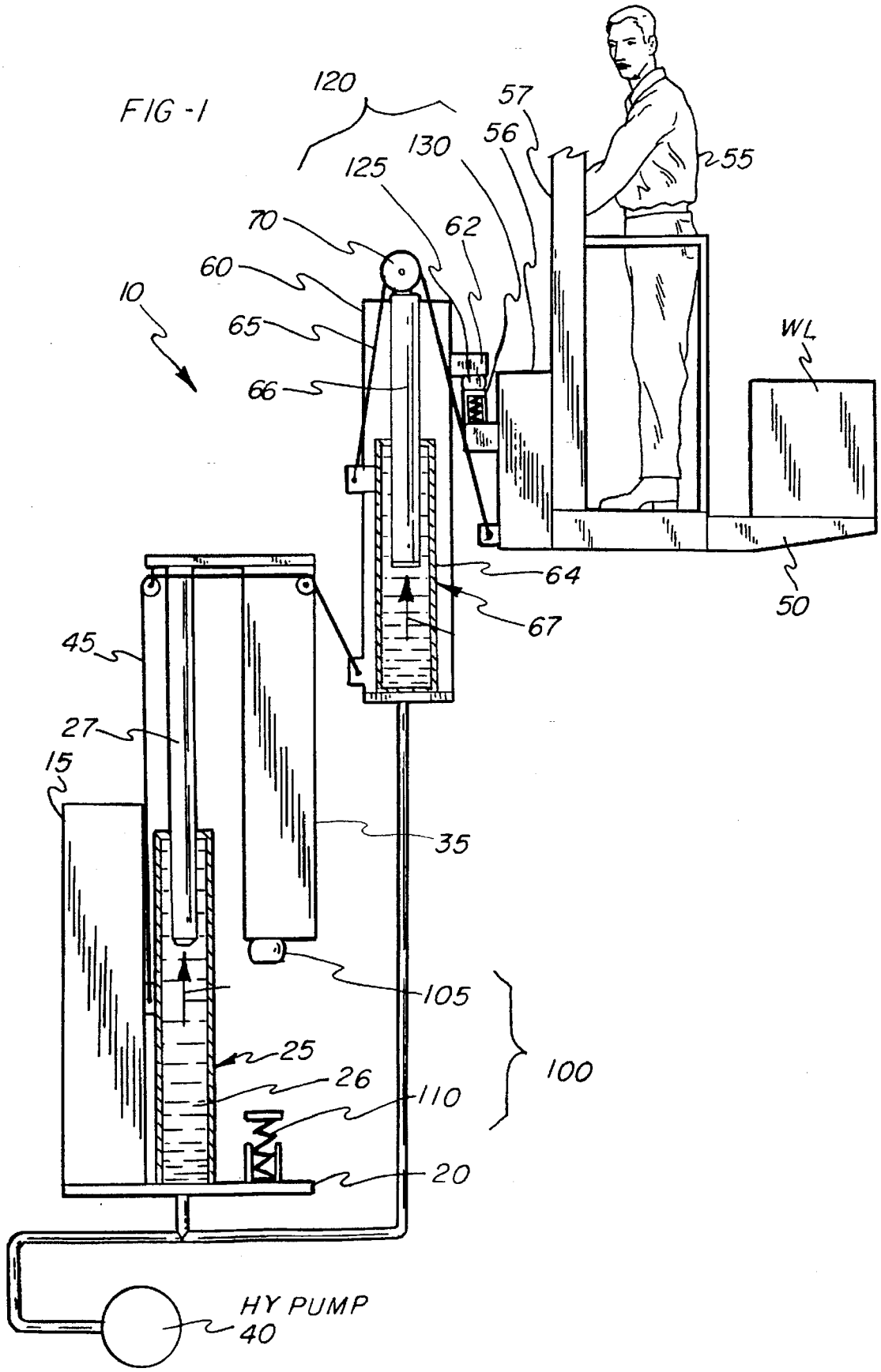
FIG. 1 is a side elevational view of a three stage lift truck with a carriage that supports load carrying forks and an operator's platform shown in the elevated position. In this view, the components are partially exploded or separated to illustrate the function of the device.

Referring now to the drawings which illustrate a preferred embodiment of this invention, FIG. 1 is an exploded view of the mast of a Crown SP3000 lift truck which is typical of the type of unit on which the present invention might be employed. This lift truck has a three stage mast with a carriage 56 that supports an operator's platform 57 and load carrying forks 50 and is hydraulically actuated. The lift truck's fixed (first stage) mast section is shown at 15. A staged lift cylinder is shown at 25, having a fixed portion 26 connected to the first stage mast section 15. A moveable portion 27 of the staged lift cylinder is connected to moveable mast section 35 (second stage). While two staged lift cylinders are typically employed, only one is shown in FIG. 1.

A free lift cylinder is shown at 67 which has a fixed portion 64 connected to a moveable mast section 60 (third stage). The third stage mast section 60 is connected to the first stage by means of a mast chain 45. A carriage supporting an operator's platform 57 and load carrying forks 50 is shown at 56. The carriage is connected to the third stage by means of a free lift chain 65. The moveable portion 66 of the free lift cylinder supports a chain sheave 70 that bears on the free lift chain 65. A hydraulic pump 40 provides hydraulic pressure to the staged lift cylinder 25 and the free lift cylinder 67. An operator 55 is shown in position on the operator's platform 57 and a load $W_L$ is shown supported on the load carrying forks 50.

A first pair of cushioning devices 100 is placed between the first stage mast section 15 and the second stage mast section 35. While two cushioning devices are typically employed, only one is shown in FIG. 1. Each cushioning device 100 comprises a bumper 105 and a spring 110.

A second pair of cushioning devices 120, only one of which is shown in FIG. 1, is placed between the carriage 56 and the third stage mast section 60. The cushioning device 120 includes a bumper 125 and a spring 130. While cushioning devices 100 and 120 have springs shown below the bumpers, it is to be understood that the order of these components may be reversed.

Figure 2:
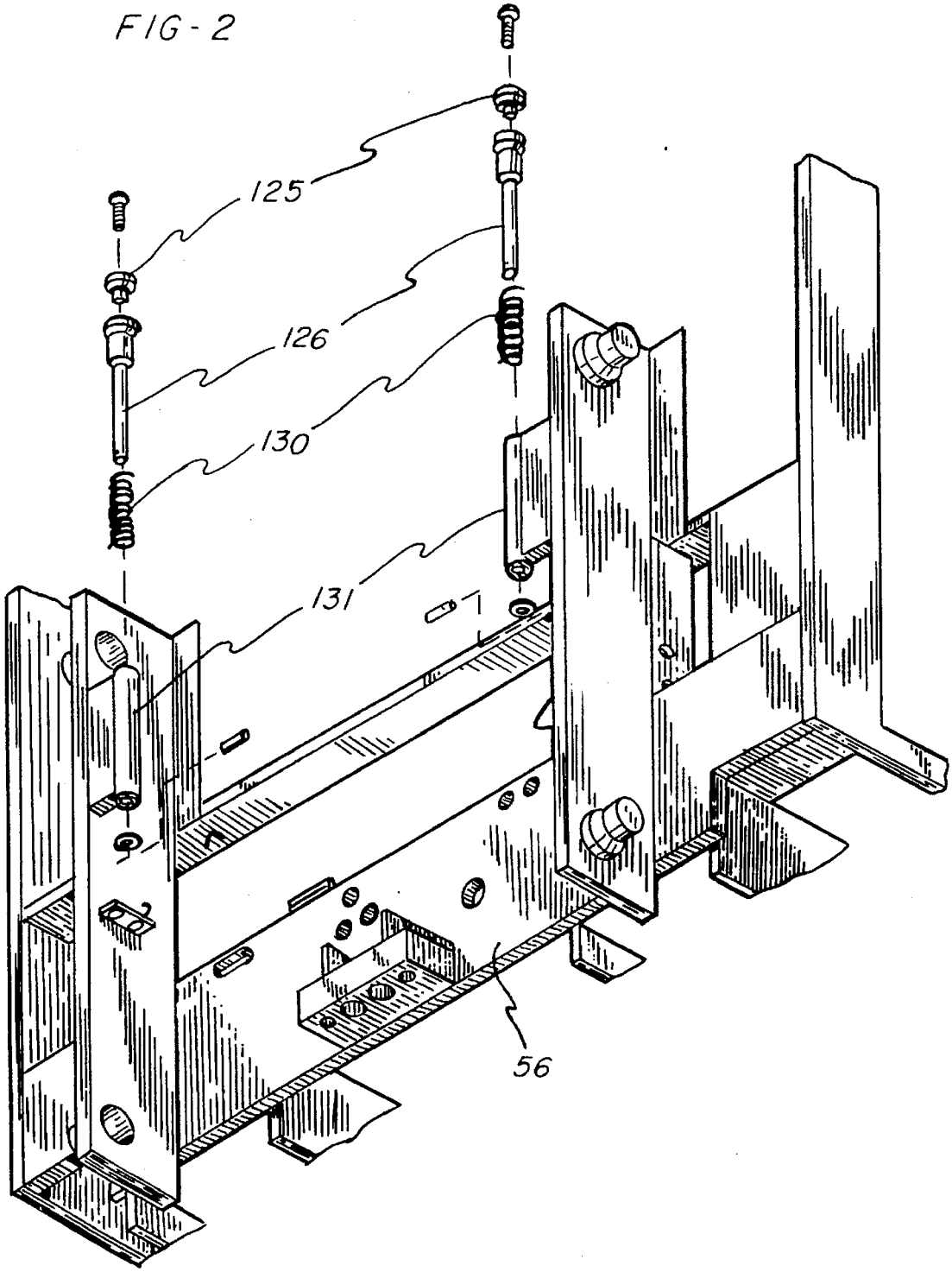
FIG. 2 is a perspective view looking upward at the back of the carriage that supports the load carrying forks and operator's platform.

Referring to FIG. 2, which shows the back of the carriage 56, two cushioning devices 120 are shown, each provided with springs 130 and bumpers 125. The springs 130 are carried in and supported by tubes 131 that are welded to the carriage 56. The bumpers 125 are attached to plungers 126 that bear on and pass through the springs 130 and are guided by the tubes 131. The plunger 126 is designed to limit the stroke of the spring 130. The bumpers 125 contact the mast stops 62 on the third stage mast section 60 shown in FIG. 1, when the carriage 56 is raised to the staging transition range, engaging the cushioning devices 120.

Figure 3:
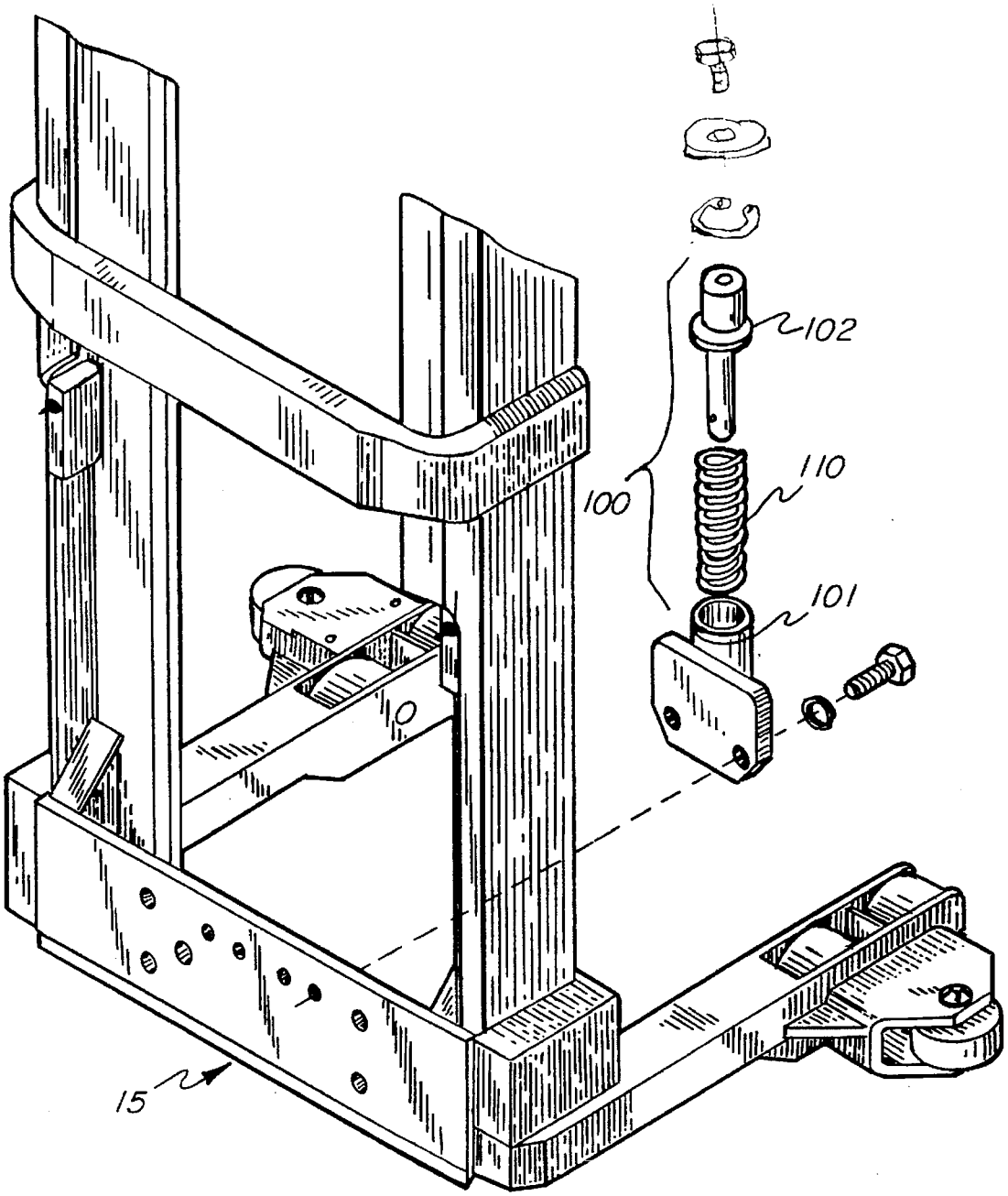
FIG. 3 is a perspective view looking downward at the back of the first stage.
Figure 4:
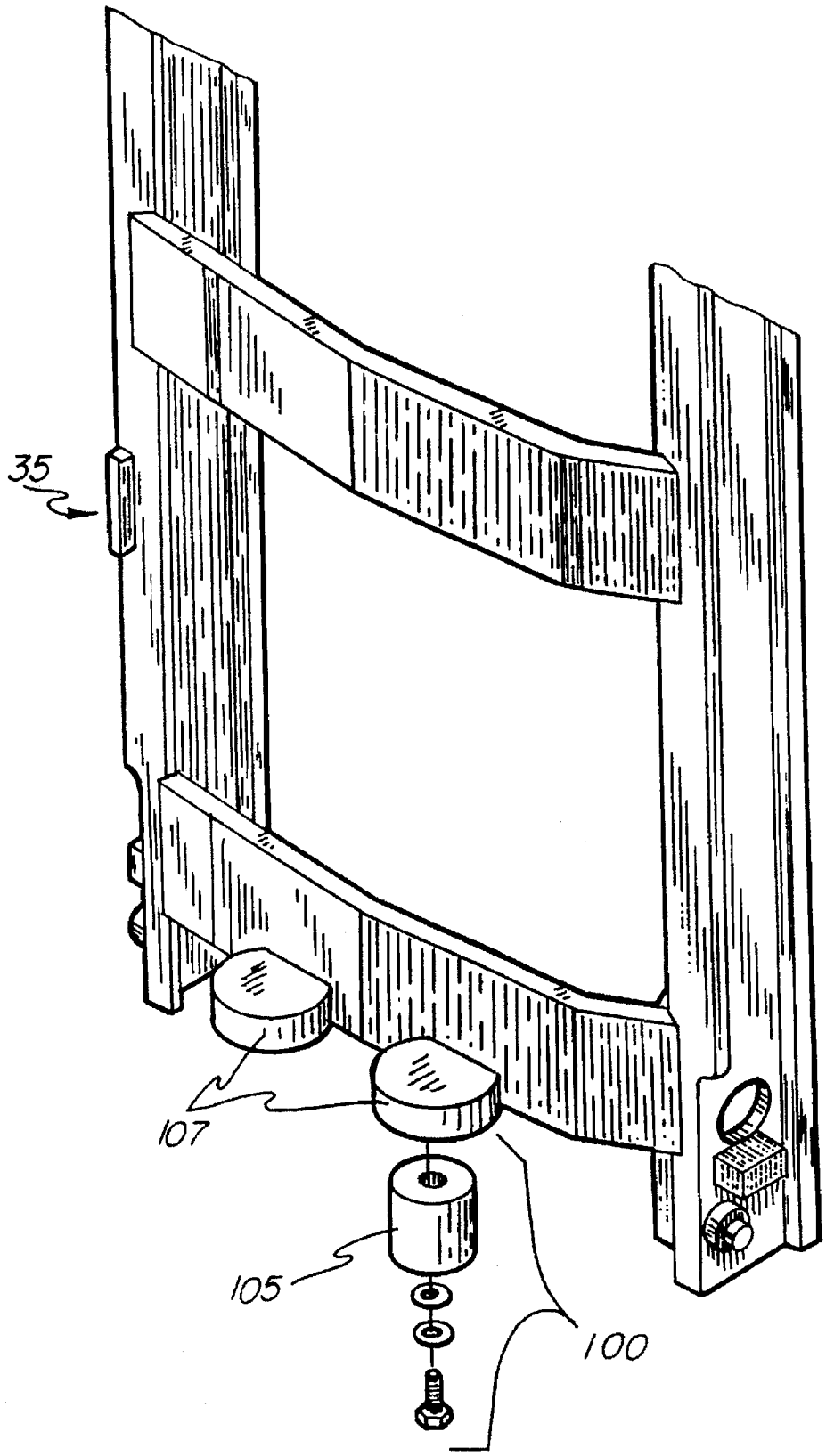
FIG. 4 is a perspective view looking downward at the back of the second stage.

Referring now to FIGS. 3 and 4, which show the back side of the fixed mast section 15 (first stage) and moveable mast section 35 (second stage) respectively, two cushioning devices 100 are provided using springs 110 and bumpers 105. Only one cushioning device is shown, although two would typically be used. The springs 110 are carried in and supported by tubes 101 which are mounted to the fixed mast section 15. The plungers 102 bear on and pass through the springs 110 and are guided by the tubes 101. The plunger 102 is designed to limit the stroke of the spring 110. Bumpers 105 are attached to extensions 107 welded to the back of the moveable mast section (second stage) 35. The bumpers 105 contact the plungers 102 when the second stage is lowered to the staging transition range, engaging the cushioning devices 100.

The proper sequencing of the movement of the carriage 56 and the moveable mast sections 35 and 60 during raising and lowering of the mast 10 occurs because of the difference in pressure required to extend the staged lift cylinder 25 and free lift cylinder 67, the common hydraulic connection between the cylinders and the mast chains 45 and 65 that provide mechanical connections between the mast stages and the carriage. The hydraulic pressure required to extend the moveable portion 66 of the free lift cylinder is less than that required to extend the moveable portion 27 of the staged lift cylinder. This pressure difference is normally referred to as the staging pressure differential. This is why the free lift cylinders 67 extend first when raising and the staged lift cylinders 25 retract first when lowering. This sequencing allows the load to be elevated from floor level to some significant portion of the total lift height (approximately one third of the lift truck's total lift height) without increasing the profile height of the lift truck above the mast collapsed profile. The ability to maintain the collapsed profile height up to some significant portion of the lift height can be an important feature in many lift truck applications.

During the sequence of raising the mast of a lift truck that does not employ the present invention, a staging transition occurs suddenly when the carriage 56, being elevated at the designated lift speed by the free lift cylinder 67, impacts the stops 62 on the third stage 60 which is at rest. This impact creates a shock that is felt by the operator. The free lift cylinder can no longer extend because the carriage 56 movement is being restrained. This will cause the hydraulic pressure to increase to the pressure required to extend the staged lift cylinder and elevate the second and third stage mast section 35 and 60. The rapid acceleration of the second and third stages mast sections from at rest to lifting speed and deceleration of the carriage 56 in relation to the mast stages 35 (and 60) causes a jerk that is felt by the operator.

During the sequence of lowering the mast of a lift truck that does not employ the present invention, a staging transition occurs suddenly when the second stage mast section 35, being lowered at the designated lowering speed by the staged lift cylinder 25 impacts the fixed mast section 15. This impact creates a shock that is felt by the operator. The hydraulic pressure will then decrease because the weight of the second and third stage 35 and 60 is no longer supported by the staged lift cylinder 25. This causes the free lift cylinder 64 to begin to collapse, lowering the carriage in relation to the second and third stage mast section 35 and 60. The rapid deceleration of the second and third stage mast section 35 and 60 from lowering speed to rest and the acceleration of the carriage 56 in relation to the second and third stage mast section 35 and 60 causes a jerk that is felt by the operator.

The present invention adds cushioning devices 100 and 120 to the original mast design. These devices cause the moveable mast sections to gradually accelerate or decelerate the during the staging transition, thus reducing the jerk, as well as reducing the relative velocities between the stages, thus reducing the impact. The bumpers absorb the remaining impact energy over some finite length of stroke, further reducing the staging shock. This system functions equally well for both raising and lowering and regardless of fork load or speed.

When the mast 10 is in a fully lowered position, the free lift and staged lift cylinders 67 and 25 are fully collapsed. The cushioning devices 100 are engaged between the fixed mast section 15 and the moveable mast section 35 and are collapsed. The relatively soft spring element 110 in the cushioning device 100 is compressed to the point allowed by the design of the plunger 102. The relatively stiff spring element formed by the polymeric bumper 105 is compressed between the plunger 102 which is stopped against the tube 101 and the extensions 107, creating a near firm positioning stop for the lowered mast. The force exerted by the compressed spring 110 and the bumper 105 has reduced the staging pressure differential by counterbalancing part of the weight of the second and third stage mast sections 35 and 60.

When the load raising operation is initiated, hydraulic pressure is supplied by the hydraulic pump 40 and the moveable portion 66 of the free lift cylinder 67 begins to move upward at free lift pressure which causes the carriage 56 to move upward in relation to the third stage mast section 60. As the carriage 56 nears the top of the third stage mast section 60, the bumpers 125 contact the mast stops 62 on the third stage mast section 60, eliminating metal to metal contact between the carriage and the third stage mast section and engaging the cushioning devices 120. As the free lift cylinder 67 continues to extend, the springs 130 begin to compress, causing a gradual increase in hydraulic pressure by opposing the extension of the cylinder.

When the hydraulic pressure has risen sufficiently to overcome the reduced staging pressure differential, the staging transition will begin. The moveable portion 27 of the staged lift cylinder 25 will begin to move upward and, assisted by the compressed springs 100, will begin to raise the second and third stage mast sections 35 and 60. As the cylinders 67 and 25 continue to extend, the hydraulic pressure increases gradually to the staged lift pressure due to the increasing opposition of the springs 130 as they continue to compress and the decreasing assistance from the springs 110 as they continue to extend.

A common hydraulic circuit connection between the staged lift and free lift cylinders 25 and 67 permits the cylinders to extend simultaneously during the staging transition, gradually accelerating the second and third stage mast sections 35 and 60 and gradually decelerating the carriage 56 in respect to the third stage mast section 60. This gradual change in acceleration and deceleration will reduce the jerk felt by the operator and will reduce the relative velocity between the carriage 56 and the third stage mast section 60, reducing the impact.

As the cylinders 67 and 25 continue to extend, the springs 130 will compress to the extent allowed by the plunger 126 and the bumpers 125 will be placed in compression between the tubes 131 and the mast stops 62. The relative motion between the carriage 56 and third stage mast section will cease as the bumpers 125 provide a near firm positioning stop between the carriage and third stage mast section and absorb the remaining impact energy, reducing the shock felt by the operator. Further upward extension of the mast 10 will result from the continued extension of the staged lift cylinder 25 at staged lift pressure causing elevation of the moveable mast sections 35 and 60 and the carriage 56, but with no motion of the carriage 56 in relation to the third stage mast section 60.

When the mast 10 is in a fully raised position, the free lift and staged lift cylinders 67 and 25 are fully extended. The cushioning devices 120 are engaged between the carriage 56 and the third stage mast section 60 and are collapsed. The relatively soft spring element 130 in the cushioning device 120 is compressed to the point allowed by the plunger 126. The relatively stiff spring element formed by the polymeric bumper 125 is compressed between the plunger 126 which is stopped against the tube 131 and the mast stop 62, creating a near firm positioning stop between the carriage 56 and the third stage mast section 60. The force exerted by the compressed spring 130 and the bumper 125 has reduced the staging pressure differential by opposing the force exerted by the free lift cylinder 67.

When the load lowering operation is initiated, the moveable portion 27 of the staged lift cylinder 25 begins to move downward at staged lift pressure, which causes the moveable mast sections 35 and 60 and the carriage 56 to move downward, but with no relative motion between the carriage 56 and the third stage section 60. As the second stage mast section 35 nears the bottom of the fixed mast section 15, the bumpers 105 contact the plungers 102, eliminating metal to metal contact between the second stage mast section and fixed mast section and engaging the cushioning devices 100. As the staged lift cylinders 25 continue to retract, the springs 110 begin to compress, causing a gradual decrease in the staged lift pressure by counterbalancing part of the weight of the second and third stage mast sections 35 and 60.

When the pressure has fallen sufficiently to be overcome by the reduced staging pressure differential, the staging transition will begin. The moveable portion 66 of the free lift cylinder will begin to move downward and assisted by the compressed springs 130 will begin to move the carriage 56 downward in relation to the third stage mast section 60.

As the cylinder 25 and 67 continue to retract, the hydraulic pressure decreases gradually to the free lift pressure due to the decreasing opposition of the springs 130 as they continue to extend and the increasing assistance from the springs 110 as they continue to compress. The common hydraulic connection between the staged lift and free lift cylinder 25 and 67 permits the cylinders to retract simultaneously during the staging transition, gradually decelerating the second and third stage mast sections 35 and 60 and gradually accelerating the carriage 56 in relation to the third stage mast section 60. This gradual change in acceleration and deceleration will reduce the jerk felt by the operator and will reduce the relative velocity between the second stage mast section 35 and the fixed mast section 15, reducing the impact.

As the cylinders 67 and 25 continue to retract, the springs 110 will compress to the extent allowed by the plungers 102 and the bumpers 105 will be placed in compression between the tubes 101 and the extensions 107. The relative motion between the second stage mast section 35 and the fixed mast section 15 will cease as the bumpers 105 provide a near firm mast positioning stop between the second stage and fixed mast section and absorb the remaining impact energy reducing the shock felt by the operator.

Further downward retraction of the mast 10 will result from the continued collapse of the free lift cylinder 67 at free lift pressure, allowing downward motion of the carriage 56 in relation to the third stage mast section 60.

While the form of apparatus herein described constitutes a preferred embodiment of this invention, it is to be understood that the invention is not limited to this precise form of apparatus and that changes may be made therein without departing from the scope of the invention, which is defined in the appended claims.

What is claimed is:

1. In a lift truck of the type including a fixed mast section, a first vertically movable mast section, a first hydraulic cylinder connected between said fixed mast section and said first movable mast section, a second vertically movable mast section, a load platform, and a second hydraulic cylinder connected between said second movable mast section and said load platform, and hydraulic means for controlling the extension and retraction of said hydraulic cylinders, the improvement comprising a first cushioning device placed between said fixed mast section and said first movable mast section to provide a cushion when said first movable mast section is in a lowermost vertical position, a second cushioning device placed between said load platform and said second movable mast section to provide a cushion when said load platform is in a uppermost vertical position, each of said first and said second cushioning devices including a combination of stiff and soft spring elements, and means forming a common hydraulic circuit between said first and second hydraulic cylinders, wherein the hydraulic pressure required to extend said second cylinder is less than that required to extend said first cylinder whereby, during a load rasing operation, said second cylinder will extend before said first cylinder, and during a load lowering operation, said first cylinder will retract before said second cylinder, and whereby said first and second cushioning devices will cause both cylinders to accelerate and decelerate gradually and to extend and retract simultaneously during staging.

2. A method of cushioning the shock during staging of a lift truck including at least two extendable hydraulic cylinders, the method comprising the steps of placing a first cushioning device between engaging lift truck elements for engagement during retraction of said cylinders, said first cushioning device including a stiff spring and a soft spring, placing a second cushioning device between engaging lift truck elements for engagement during extension of said cylinders, said second cushioning device including a stiff spring and a soft spring, providing a common hydraulic circuit between said cylinders, adjusting the spring rate of said soft spring to permit simultaneous movement of said cylinders during staging, and adjusting the spring rate of said stiff spring to absorb impact energy.

3. In the method of claim 2 wherein said lift truck includes first and second hydraulic cylinders, said first hydraulic cylinder being connected between a fixed mast section and a first movable mast section, said second hydraulic cylinder connected being connected between a second vertically movable mast section and a load platform, whereby during extension, said second hydraulic cylinder will extend first to raise said load platform when hydraulic pressure is applied to said hydraulic circuit, and when the load platform reaches the uppermost vertical position, said second cushioning means will be engaged, said soft spring element will begin to compress, thus causing a gradual increase in hydraulic pressure in said second hydraulic cylinder to the point where the hydraulic pressure in said first hydraulic cylinder is sufficiently high to begin extension thereof, thus allowing simultaneous extension of both hydraulic cylinders until said stiff spring element of said second cushioning device is engaged.

4. The method of claim 3 wherein during retraction, said first hydraulic cylinder will retract first to lower said first movable mast section when hydraulic pressure is released from said hydraulic circuit, and when the first mast section reaches the lowermost vertical position, said first cushioning means will be engaged, said soft spring element will begin to compress, thus causing a gradual decrease in hydraulic pressure in said second hydraulic cylinder to the point where the hydraulic pressure in said second hydraulic cylinder is sufficiently reduced to begin retraction thereof, thus allowing simultaneous retraction of both hydraulic cylinders until said stiff spring element of said first cushioning device is engaged.

* * * * *